US006223400B1

(12) United States Patent
Lenack

(10) Patent No.: US 6,223,400 B1
(45) Date of Patent: May 1, 2001

(54) SEALING DEVICE FOR A CONTAINER AND THE LIKE

(76) Inventor: Roger D. Lenack, 20357 Tuba St., Chatsworth, CA (US) 91311

( * ) Notice: Subject to any disclaimer, the term of this patent is extended or adjusted under 35 U.S.C. 154(b) by 0 days.

(21) Appl. No.: 09/420,142

(22) Filed: Oct. 18, 1999

(51) Int. Cl.[7] ..... A41D 25/00; A44B 18/00

(52) U.S. Cl. ..... 24/306; 229/125.39; 229/125.37; 229/148.3; 229/125.01; 229/125.33

(58) Field of Search ..... 229/125.39, 247, 229/125.33, 125.37, 198.2, 198.3, 125.01, 125; 24/306, 442, 304, 450; 428/100

(56) References Cited

U.S. PATENT DOCUMENTS

| | | | | |
|---|---|---|---|---|
| 1,483,175 | | 2/1924 | Guenther . | |
| 1,487,363 | | 3/1924 | Rothermund . | |
| 3,848,594 | * | 11/1974 | Buell | 604/390 |
| 4,333,602 | * | 6/1982 | Geschwender | 229/125.39 |
| 4,556,167 | | 12/1985 | Fox et al. . | |
| 4,606,079 | * | 8/1986 | DeWoskin | 24/306 X |
| 4,638,912 | | 1/1987 | Graf . | |
| 4,741,935 | | 5/1988 | Sheehan, Jr. . | |
| 4,771,936 | * | 9/1988 | Dolby | 229/125.37 X |
| 5,053,028 | * | 10/1991 | Zoia et al. | 604/385.1 |
| 5,076,465 | * | 12/1991 | Lawson | 221/47 |
| 5,279,604 | * | 1/1994 | Robertson et al. | 604/389 |
| 5,286,112 | * | 2/1994 | Bible | 24/306 X |
| 5,503,325 | * | 4/1996 | Nelson et al. | 229/125.39 |
| 5,577,302 | * | 11/1996 | Bortle | 24/306 X |
| 5,887,782 | | 3/1999 | Mueller . | |
| 5,968,031 | * | 10/1999 | Schmitz | 604/391 |
| 6,045,037 | * | 4/2000 | McGeehin | 229/125.39 |

* cited by examiner

*Primary Examiner*—Stephen P. Garbe
(74) *Attorney, Agent, or Firm*—Alan R. Davis; Louis Dachs

(57) ABSTRACT

The invention is a sealing device for connecting together at least first and second portions of a container, the second portion having first and second surfaces and an edge therebetween. The sealing device includes a first half of a hook and loop type fastener assembly, the first half having an adhesive coating for attaching to the first portion of the container. The device also includes a strip having first and second sections, the first section in the form of a forked end with first and second legs. The first and second legs include an adhesive coating for attaching the legs to the first and second surfaces, respectively, with the edge therebetween of the second portion of the container. A second half of a hook and loop type fastener assembly is mounted on the second section of the strip attachable to the first half of the hook and loop type fastener. Thus when the first half of the hook and loop type fastener assembly is attached to the first portion and the legs of the first section of the strip are attached to the first and second surfaces of the second portion with the edge therebetween, the first and second halves of said hook and loop type fastener assembly can be attached to each other securing the two portions of the container together.

3 Claims, 4 Drawing Sheets

FIG. 1
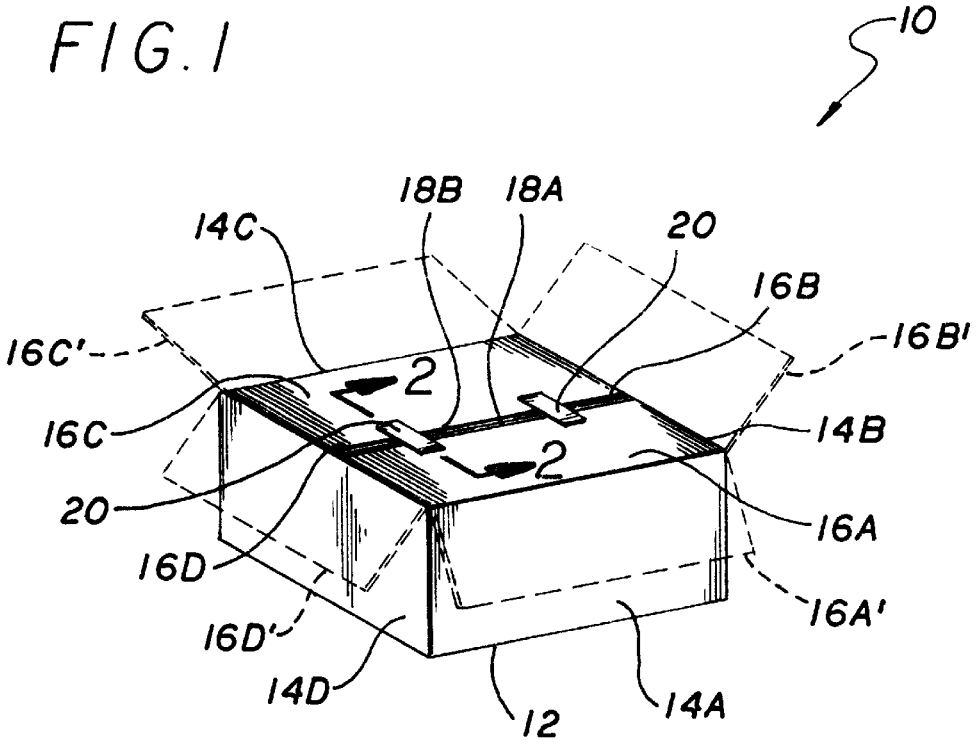
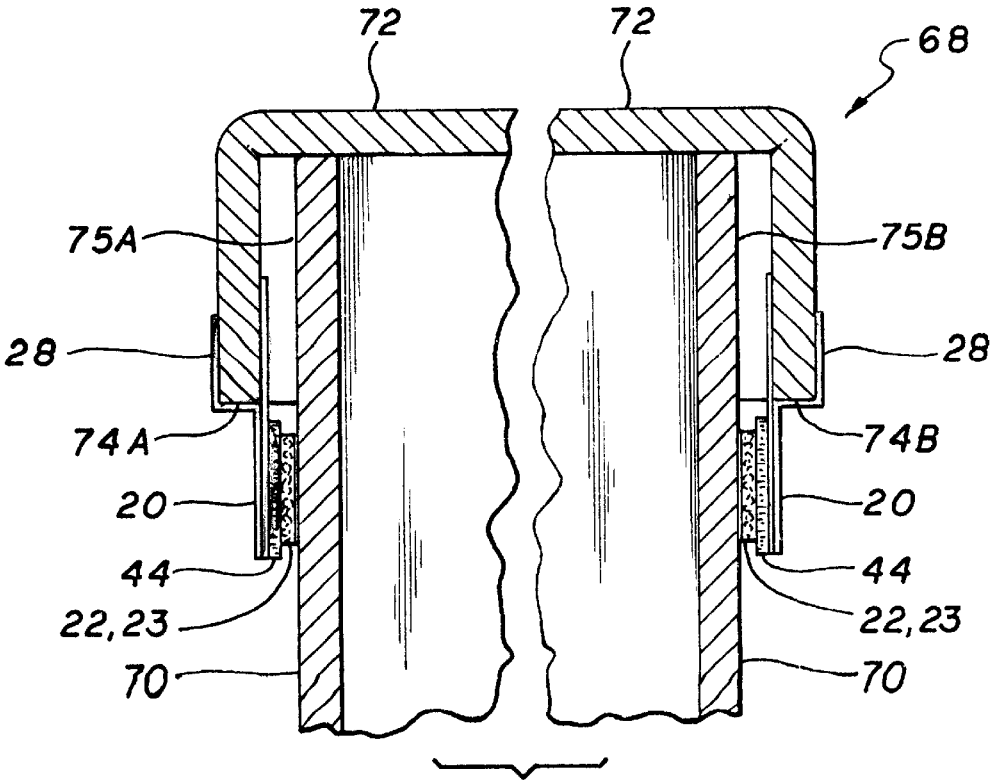
FIG. 4

SEALING DEVICE FOR A CONTAINER AND THE LIKE

BACKGROUND OF THE INVENTION

1. Field of the Invention

The invention relates to the field of sealing devices for containers such as cardboard boxes and, in particular, to a device that is simple to install, provides for repeated opening and closings of the lids of the box, and is inexpensive to manufacture.

2. Description of Related Art

Because containers such as cardboard boxes are inexpensive they are in wide use as storage and shipping containers. When they are used as shipping containers they commonly sealed with tape. Upon opening, the tape must be "ripped off because of its adherence to the lids of the box, and the container is often thereafter discarded. There are many devices available for one time sealing of the box. For example, U.S. Pat. No. 1,483,175 "Sealing Device" by A. G. G. Guenther discloses a one time metal sealing bracket assembly. The assembly comprises two strips of metal; one attached to each lid half by tangs that perforate the lid and which are thereafter bent over locking the strip in place. One strip includes a slot portion in which the other strip is inserted as the two lids are closed. The sides of the slot are then crimped locking the two strips together. U.S. Pat. No. 1,487,363 "Lock For Cartons" by W. F. Rothermund also discloses a one time use device for securing the lids of cartons. In this case a female bracket in the form of flattened "U" shaped member is secured to one lid by bent over tangs extending through the lid. One leg of the U incorporates a plurality of catches in the form of upward extending tangs. The male portion is attached to the other lid by tangs extending therethrough and bent over. It also includes an end portion having openings or slots. When the lids are brought together closing off the carton, the slotted end portion is inserted into the U such that tangs engage the slots. Once this is accomplished, the only way to open the carton is to rip-off the lock. This, as in the first mentioned example, destroys the lids and may render the box unusable.

However, there are many instances where such containers are continuously in use and repeated access is required. Many such boxes incorporate reusable lid closure devices. For example, U.S. Pat. No. 4,333,602 "Recloseable Container" by R. C. Geschwender, U.S. Pat. No. 4,556,167 "Velcro Fastening Arrangement For Recloseable Carton Flats" by J. D. Fox, et al., U.S. Pat. No. 5,887,782 "High Stacking Strength Automatic Corrugated Box" by C. J. Mueller, and U.S. Pat. No. 4,638,912 "Package With Transferable Reusable Closure Element" by H. Graf all disclose the use of VELCRO™ pads. However, the VELCRO™ pads are just attached to one surface of the lid, thus there is a chance that one of the pads can be pulled off the lip. In addition, to use simple VELCRO™ fastener pads, the lids must overlap, a feature not found in most such containers.

U.S. Pat. No. 4,741,935 "Adhesive Tape Closure" by R. I. Sheehan, Jr. discloses a system wherein tape is used. First and second strips of tape are permanently bonded to each lid of a container such that they overlap the adjacent edges thereof where the two edges of the lid meet. The first (bottom) strip's upper surface and the adhesive on the under side of the second (lower) strip are selected to allow their separation. A cover is releasably bonded over the overlapped portions of the first and second strips. Thus once jointed, the container can be opened by removing the cover and separating the first and second overlapped strips. This system has the disadvantage of requiring a separate cover, which must be handled with great care lest it become stuck to some other surface or object; or worse, contaminated with dirt.

There are numerous other locking systems such as string and button systems where buttons are attached to the outer surfaces of the carton lids and a string is wound back and forth between the buttons. Another approach is to use hook and eyelets. All such fastener assembly approaches require significant installation procedures.

Thus, it is a primary object of the invention to provide a reusable sealing device for a container that is reusable.

It is another primary object of the invention to provide a sealing device for a container wherein the sealing device remains fastened to the lids upon opening of the container.

It is a further object of the invention to provide a sealing device for a container that does not require the container to be customized in any manner.

It is another primary object of the invention to provide a sealing device for a container that has high strength.

It is another primary object of the invention to provide a sealing device for a container that is easy to manufacture.

It is a still another primary object of the invention to provide a sealing device that join sections of flat structures together.

SUMMARY OF THE INVENTION

The invention is a sealing device primarily for a container, the container having at least two portions that must be secured together to affect closing thereof with the second portion having exterior and interior surfaces and an edge. For example, a container such as a cardboard box, having a bottom and side-walls. Top lid portions are attached to the top of the sidewalls that are movable from an open position to a closed position wherein the edges of the lid portions are in proximity to each other forming a top closure to the container. In this example, the portions to be secured together are two opposing lid portions. A second example is an open box having a cover that fits over the open end and the two portions requiring securing are the over hanging edge of the lid (second portion with an edge) and the sidewalls. A third example is a pouch type container having a foldable flap. Here the two portions that require securing are the flap (second portion with an edge) and the body of the pouch. Further examples include containers having full over-lapping flaps covering the opening thereof and portfolio type containers. In addition, the sealing device can be used to join panels of an enclosure or panels of a display stand together.

In detail, the invention is a sealing device for connecting together at least first and second portions of a container, the second portion having first and second surfaces and an edge therebetween. The sealing device includes a first half of a hook and loop type fastener assembly, the first half having, preferably, an adhesive coating for attaching to the first portion of the container. The device also includes a strip having first and second sections, the first section in the form of a forked end with first and second legs. The first and second legs preferably include an adhesive coating for attaching the legs to the first and second surfaces, respectively, with the edge therebetween of the second portion of the container. Preferably, the strip is made of a flexible material.

A second half of a hook and loop type fastener assembly is mounted on the second section of the strip attachable to the first half of the hook and loop type fastener. In addition, it is desirable that the second half of the hook and loop type fastener assembly has a greater surface area than the first half in order to compensate for any misalignment of the strip with the first half of the hook and loop type fastener assembly.

In addition, in order to protect the adhesive coatings on the legs of the first section of the strip and the first half of the hook and loop type fastener assembly until use is required, a removable protective backing sheet made of non-sticking material is placed over these adhesive coatings.

Thus when the first half of the hook and loop type fastener assembly is attached to the first portion and the legs of the first section of the strip are attached to the first and second surfaces of the second portion with the edge therebetween, the first and second halves of said hook and loop type fastener assembly can be attached to each other securing the two portions of the container together.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 1 is a perspective view of a carton wherein the subject sealing device is shown mounted on the lids thereof.

FIG. 4 is a partial cross-sectional view of a container in the form of an open topped box with a separate lid with the subject sealing device installed thereon.

DESCRIPTION OF THE PREFERRED EMBODIMENT

Illustrated in FIG. 1 is a cardboard box type container 10 having a bottom wall 12, sidewalls 14A, 14B, 14C and 14D, and four lid members 16A, 16B, 16C and 16D pivotally attached to the side-walls 14A-D, respectively. With the four lid members are shown in an open position in dotted lines and indicated by numerals members 16A', 16B', 16C' and 16D'. When the lid members 16A–16C are in the closed position, these members rest on top of the members 16B and 16D and the edges 18A and 18B thereof are adjacent each other. The subject-sealing device, indicated by numeral 20, is shown in the installed condition securing the lid members 16A and 16C together sealing off the interior of the container 10.

Figure 2:
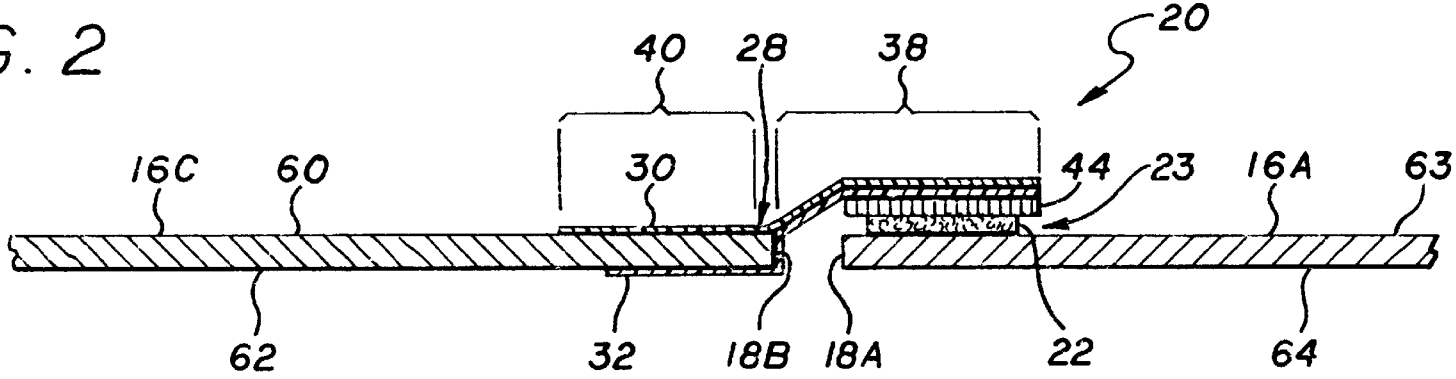
FIG. 2 is a cross-sectional view of the sealing device illustrated in FIG. 1 taken along the line 2—2.
Figure 3:
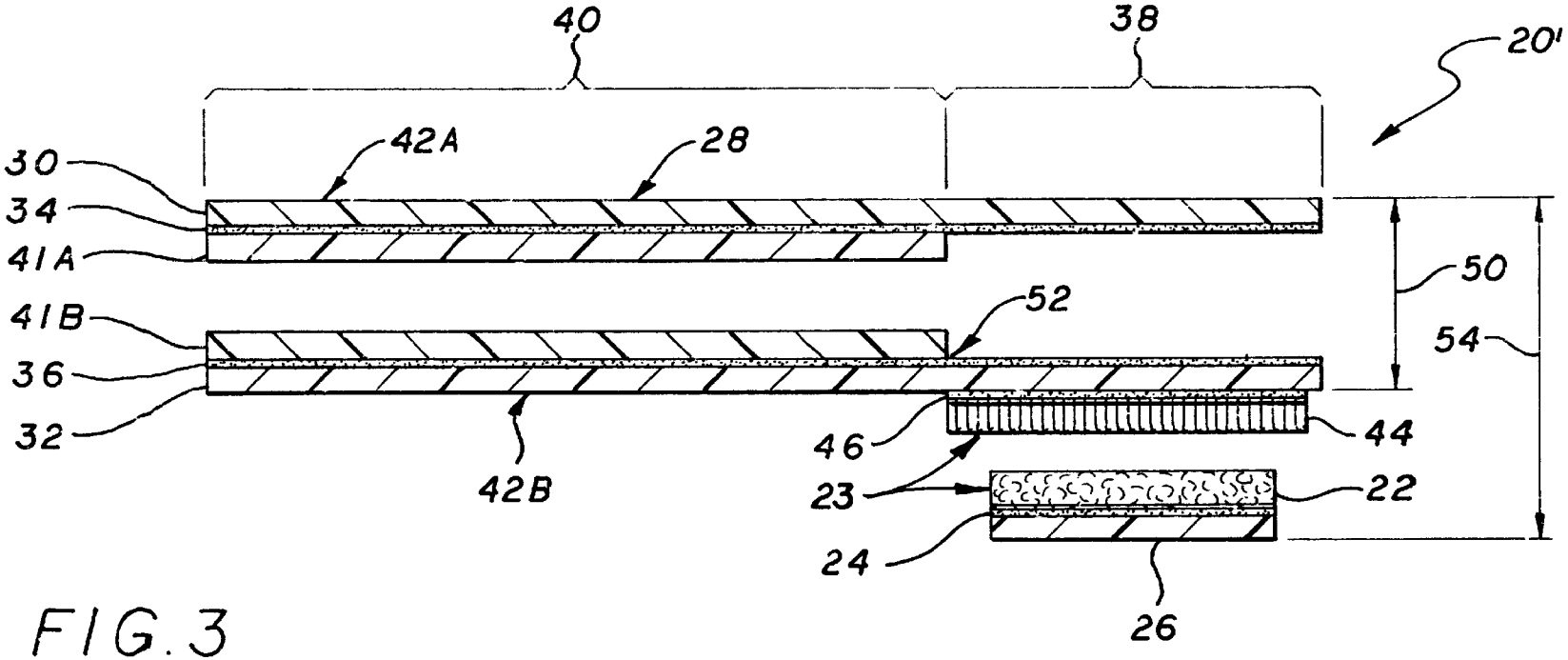
FIG. 3 is an exploded cross-sectional view of sealing device illustrated in FIG. 2 prior to installation.

The sealing device 20 normally would be supplied as a separate item and would not be installed on the container until required, for example, just prior to use; although, it could be provided on the container as purchased. Referring to FIGS. 1, 2 and 3, the device, when provided as a separate item, indicated by numeral 20', differs only in that the adhesive layers are protected by strippable covers, in a manner to be subsequently discussed. The device includes a first half 22 of a hook and loop type fastener 23. It comes with an adhesive coating 24 covered with a removable backing 26. It can be square or circular shaped about one inch square or one inch in diameter or any other geometric shape desired. Suitable "loop" and "hook" materials are P/N 192342 that comes in 2 inch×25 yard lengths and P/N 191231 that comes in 2 inch×24 yard lengths, both manufactured by Velcro USA, Incorporated, Manchester, N.H.

The device 20' further includes a strip 28 that comprises a first and second layers of tape 30 and 32, with adhesive layers 34 and 36, respectively, bonded together over a section, indicated by numeral 38, of their length. Section 40 of the strip 28 is prevented from bonding together by non-stick backing sheets 41A and 41B applied over the adhesive layers 34 and 36, respectively. Thus the un-bonded end section 40 is split or forked with two legs 42A and 42B. A Suitable tape is 2 inches wide and 5 inches in length, such as "Strapping Tape" manufactured by the 3 M Corporation, St. Paul, and MN. under the trademark Scotch™. In addition, numerous other commercially available brands are acceptable. Backing sheets 41A and 41B can be obtained from most tape manufacturing companies or can be cut from adhesive sheets and removed therefrom. Bonded to the section 38 is a second half 44 of the hook and loop type fastener 23 having an adhesive coating 46 and removable backing 48 thereon. The second half 44 is preferably larger than the first half 22, as wide as the layers of tape 30 and 32 (a 2 inch by 2 inch square). Note that the total thickness, indicated by numeral 50, of tapes 30 and 32 is less than 0.01 inch thick, and thus the transition point, indicated by numeral 52, is almost imperceptible. The total thickness, indicated by 54, of the assembled sealing device 20' is only around 0.125 inch thick. Thus the use of the sealing device does not materially affect the alignment of the lids of a container.

It is a simple matter to install the device 20'. All that is necessary is to separate the legs 42A and 42B of the strip 28 and remove the backing sheets 41A and 41B. With the lid member 16C in the open position (16C'), the portion 40 of the strip 28 is placed about the edge 18B of the lid member until the portion 38 preferably contacts the edge. However, it should be noted that it need not contact the edge 18B. Thereafter, the portion 40 is firmly pressed down on the exterior and interior surfaces 60 and 60 of the lid member 16C. Thereafter, the lid members are placed in the closed position 16A and 16C, the backing sheet 26 is removed from the half 22 of the hook and loop type fastener assembly 23, which is thereafter permanently attached to the surface 63 of lid member 16A by pressing down on the section 38 of the strip 28. Alternately, the first half 22 of the hook and loop type assembly 23 can be separated from the strip 43 and they can be joined to the lid members 16A and 16C, respectively, in separate operations.

Figure 7:
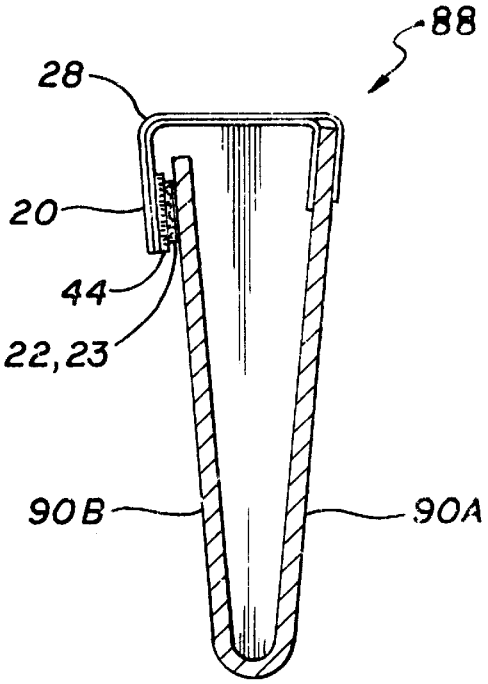
FIG. 7 is a cross-sectional view of a portfolio type container incorporating the subject sealing device.
Figure 5:
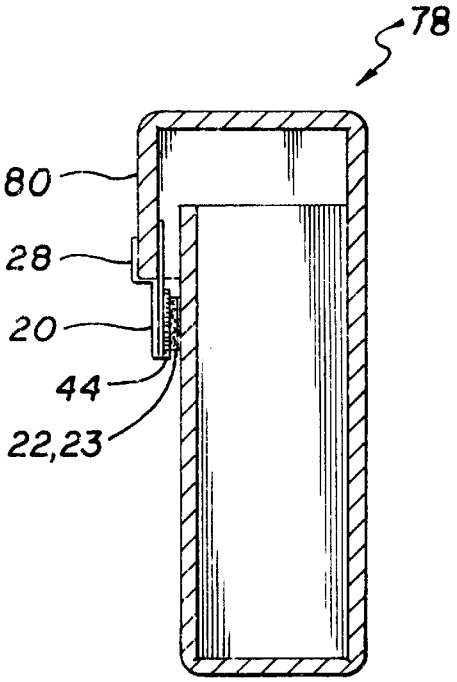
FIG. 5 is a cross-sectional view of a pouch type container incorporating the subject-sealing device.
Figure 6:
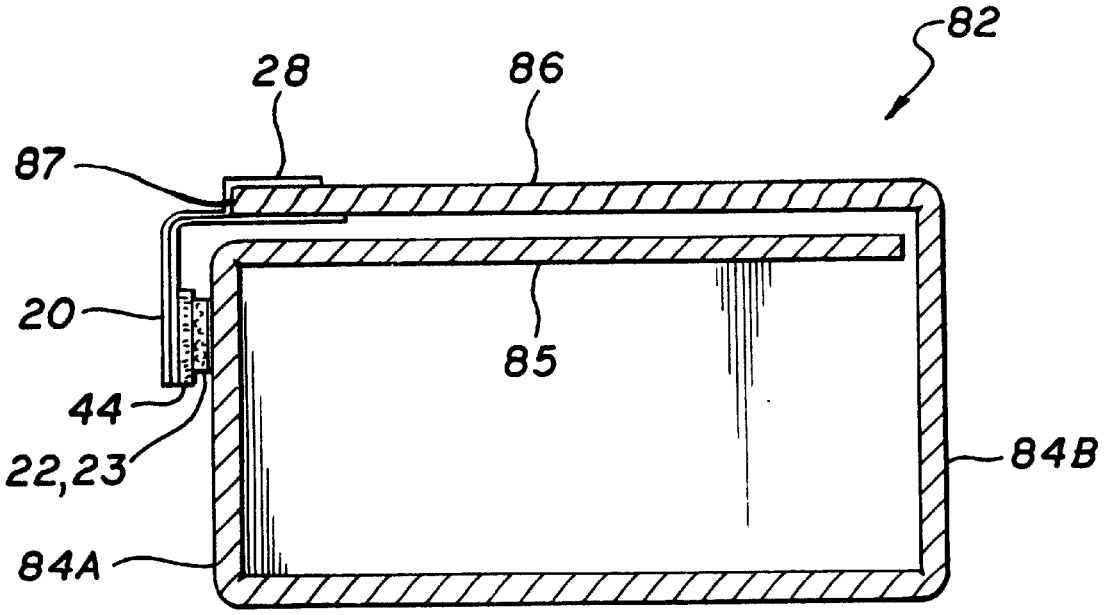
FIG. 6 is a cross-sectional view of a container having full overlapping foldable flaps incorporating the subject sealing device.

It should be noted that while a box container with foldable lids is illustrated, other types of containers could be secured with such a device 20. For example, in FIG. 4 a container 68 is illustrated consisting of an open toped container 70 with a cover 72. The strips 28 of the sealing devices 20 are attached to the ends 74A and 74B of the cover 72 while the first half 22 of the hook and loop type fastener assembly 23 is mounted on the container ends 75A and 75B. In FIG. 5 a pouch type container 78 is illustrated with the strip 28 of sealing device 20 attached to the end of a fold over flap 80 with the first half 22 of the hook and loop type fastener assembly 23 is mounted on the body of the pouch. In FIG. 6, a container 82 is illustrated having sidewalls 84A and 84B with overlapping lids 85 and 86 attached thereto. The strip 28 of the sealing device 20 is attached to the end 87 of the lid 86 while the half 22 of the hook and loop type fastener assembly 23. In FIG. 7, a portfolio type container 88 is illustrated having side- walls 90A and 90B wherein a flexible sealing assembly 20 is used to secure the ends of side-walls together. These latter two examples illustrate the advantage of having the sealing assembly made of flexible materials. Thus it is obvious that the sealing device 20 can be used in on many container designs.

The advantages of the device is that it eliminates the need for overlapping the lids of the container, a requirement when using simple hook and loop type fastener assemblies. It also reduces the possibility of ripping of the strip when opening the container. There is a tendency to pull the strip 23 off the lid when closing an "over filled" container 10 in order to align the lids. By having the strip 28 bonded to both sides of the lid, this possibility is all but eliminated. In addition, having the seal half 44 on the strip larger than the seal half 22 on the other lid allows for some misalignment on installation.

Figure 8:
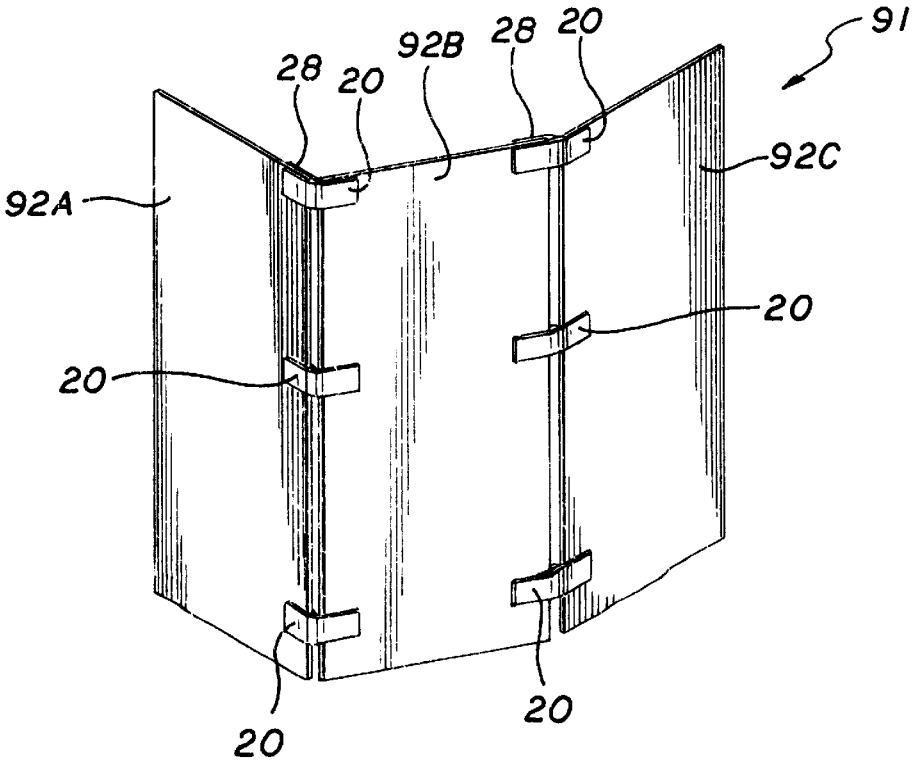
FIG. 8 is a perspective view of a series of panels joined together by the subject sealing device.

The sealing device 20 can also be used to join panels together to make an enclosure for animals or for joining panels of a display stand together. For example, illustrated in FIG. 8 is a panel 91 made up of a series of display panels 92A, 92B and 92C all joined together with a plurality of sealing devices 20. Thus it can be seen that the sealing device 20 can be used to join other structures together and not just for sealing containers.

While the invention has been described with reference to particular a embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to container manufacturing industries

What is claimed is:

1. A sealing device for connecting together at least first and second portions of a container, the second portion having first and second surfaces and an edge therebetween, the sealing device comprising;

a first half of a hook and loop type fastener assembly, said first half having an adhesive coating for attaching the first portion of the container; and a strip having first and second sections, said first section in the form of a forked end with first and second legs having facing surfaces, said first and second legs including having an adhesive coating on said facing surfaces for attaching said legs to the first and second surfaces, respectively, with the edge therebetween of the second portion of the container;

a removable protective backing sheet made of a non-sticking material mounted on said adhesive coatings on said legs of said first section of said strip and said first half of said hook and loon type fastener assembly; and a second half of a hook and loop type fastener assembly mounted on second section of said strip; attachable to said first half of said hook and loop type fastener;

such that when said first half of a hook and loop type fastener assembly is attached to said first portion and said legs of said first section of said strip are attached to the first and second surfaces of the second portion with the edge therebetween of the container, said first and second halves of said hook and loop type fastener assembly can be attached to each other securing the two portions of the container together.

2. The device as set forth in claim 1 wherein said second half of said hook and loop type fastener assembly has a greater surface area than said first half.

3. The device as set forth in claim 1, also comprising said strip is made of a flexible material.

* * * * *